United States Patent [19]

Mourrier et al.

[11] Patent Number: 4,584,927

[45] Date of Patent: Apr. 29, 1986

[54] SWASH PLATE MECHANISM, PARTICULARLY FOR A PUMP DRIVE

[75] Inventors: Francis Mourrier, Autun; Roger Badaut, Le Breuil, both of France

[73] Assignee: Creusot Loire, Paris, France

[21] Appl. No.: 625,768

[22] Filed: Jun. 28, 1984

[30] Foreign Application Priority Data

Jul. 1, 1983 [FR] France ..... 83 10962

[51] Int. Cl.[4] ..... F01B 3/00; F04B 1/12

[52] U.S. Cl. ..... 92/71; 417/269; 91/499; 74/60

[58] Field of Search ..... 74/60, 839; 417/269-272; 91/499; 92/12.2, 71; 123/58 B

[56] References Cited

U.S. PATENT DOCUMENTS

| | | | |
|---|---|---|---|
| 1,781,068 | 11/1930 | Michell | 92/71 X |
| 2,095,316 | 10/1937 | Davis, Jr. | 417/269 |
| 2,141,935 | 12/1938 | Rose | 74/60 X |
| 2,474,396 | 6/1949 | Groves | 417/269 |
| 2,498,679 | 2/1950 | Hall | 74/60 |
| 3,006,324 | 10/1961 | Shaw | 74/60 |
| 3,885,444 | 5/1975 | Chanlon | 74/60 |
| 3,999,895 | 12/1976 | Boyle | 417/271 |
| 4,101,250 | 7/1978 | Nakayama et al. | 417/269 |
| 4,342,544 | 8/1982 | Pere | 417/269 |
| 4,401,415 | 8/1983 | Hammelmann | 417/270 |

FOREIGN PATENT DOCUMENTS

| | | | |
|---|---|---|---|
| 527635 | 6/1931 | Fed. Rep. of Germany | 91/499 |
| 2506857 | 12/1982 | France | 417/271 |

*Primary Examiner*—William L. Freeh
*Assistant Examiner*—Paul F. Neils
*Attorney, Agent, or Firm*—Pollock, Vande Sande & Priddy

[57] ABSTRACT

A swash plate mechanism, especially for high power swash plate pumps, incorporating, inside a casing (2) bounded by two end walls (21, 22), a driving component (3) mounted so as to rotate about a longitudinal axis (30), an inclined plate (5) bearing upon the driving component (3) and mounted so as to swivel on the latter about an inclined axis (50). The two end walls (21, 22) of the casing are joined at their periphery by additional lateral tie rods (80) parallel to the central tie rod (8), bearing upon the two end walls (21, 22) of the casing (2) and subjected to a preload tension in order to carry the forces developed by the pistons (6) in co-operation with the central tie rod.

4 Claims, 2 Drawing Figures

SWASH PLATE MECHANISM, PARTICULARLY FOR A PUMP DRIVE

FIELD OF THE INVENTION

The subject of the invention is a swash plate mechanism particularly applicable to a pump drive. Such mechanisms, which have been known for a long time, incorporate, inside a casing, a driving component mounted so as to rotate about a longitudinal axis, on which is arranged an axis of swivelling for a swash plate inclined relative to the longitudinal axis and bearing against the driving component through the intermediary of an axial abutment. The pump incorporates several pistons, spaced about the longitudinal axis, and sliding parallel to the latter in cylindrical bodies arranged in a frame fixed to one of the end walls of the casing in which the mechanism is situated. Each piston is individually joined to the inclined plate, for example through the intermediary of a jointed connecting rod, and the inclined plate is locked against rotation. In this way, when the driving component is driven in rotation, the inclined plate moves with an oscillating motion about the point where its axis of swivelling intersects the longitudinal axis of rotation, which thus constitutes a center of oscillation. As the inclined plate is locked against rotation, this oscillating motion causes an alternating longitudinal motion of the pistons through the intermediary of jointed connecting rods. Longitudinal forces are thus developed by the pistons between the frame fixed to the rear end wall of the casing and the inclined plate which bears upon the driving component, the latter bearing in turn, through the intermediary of an axial abutment, upon the front end wall of the casing. Thus the combination of forces must be withstood by the casing, more especially by the two end walls of the latter and the lateral wall which joins them together. When the pump is of high power, the casing must withstand large forces, and this leads to very heavy and bulky constructions.

PRIOR ART

In order to lighten the pump, U.S. Pat. No. 3,885,444 proposes that the two end walls of the casing be joined together by a central tie rod whose ends bear upon the outer surfaces of the two end walls and which is put under a preload tension capable of balancing the forces developed by the pistons. Preferably, the preload force is carried when at rest by a strut column interposed between the inner surfaces of the two end walls, its center lying on the longitudinal axis of rotation, and through which the preloaded tie rod passes.

The forces, developed by the pistons along their axes of sliding and carried by the central tie rod and by the lateral walls, are applied to the two end walls of the casing. The latter are thus subjected to alternating forces, directed along the axes of the pistons and which depend upon the position of the inclined plate.

SUMMARY OF THE INVENTION

The aim of the invention is to propose improvements to this arrangement which allow the casing to withstand the alternating forces, even in the case of a high power pump, while retaining a relatively light construction.

In accordance with the invention, the two end walls of the casing are joined at their periphery by a number of additional lateral tie rods parallel to the central axis, bearing upon the two end walls of the casing and subjected to a preload tension capable of counteracting the forces developed by the pistons, in co-operation with the central tie rod, each piston corresponding either to a single lateral tie rod, whose center lies in the radial plane passing through the central axis and the axis of sliding of the piston, or to a pair of lateral tie rods positioned symmetrically on each side of the corresponding radial plane. In a preferred embodiment, the rotating driving component bears upon the front end wall of the casing along a circumference, whose center lies on the longitudinal axis, passing through the axes of the pistons, through the intermediary of a circular rib arranged on a fixed transverse plate positioned at the front end of the central strut column.

BRIEF DESCRIPTION OF THE DRAWINGS

The invention will, however, be better understood from the description of a particular embodiment, given by way of example and illustrated in the accompanying drawings.

DETAILED DESCRIPTION

Figure 1:
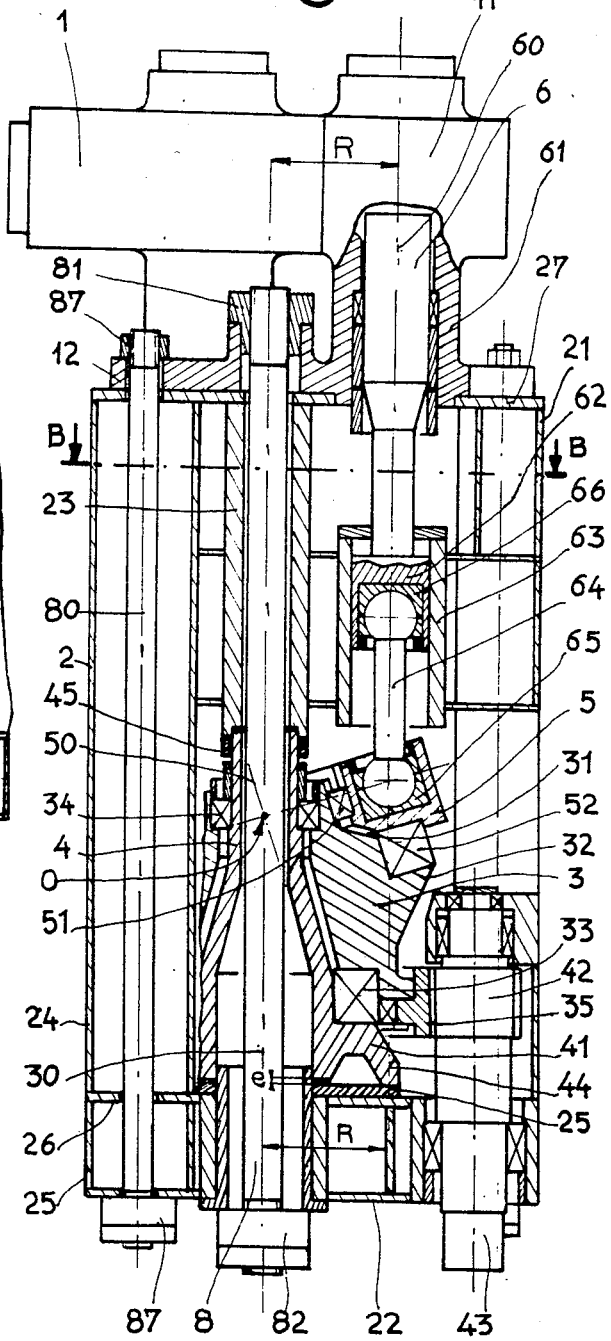
FIG. 1 is a view of the assembly of the pump and of the mechanism, sectioned longitudinally along line A—A shown in FIG. 2.

FIG. 1 shows the assembly of the pump 1 and of the driving mechanism positioned inside a casing 2 and incorporating a driving component 3 mounted so as to rotate about an axis 30 on a hollow column 4 and on which an inclined plate 5 is mounted so as to swivel about an axis 50 inclined at an angle (i) relative to the longitudinal axis 30 and intersecting the latter at a center of oscillation 0.

The pump 1 incorporates a number of pistons 6 each mounted so as to slide along an axis 60 parallel to the longitudinal axis 30, inside a cylindrical body 61 firmly fixed to the frame 11 of the pump. In the embodiment shown, each piston 6 is firmly fixed to a slide 62 guided along the axis 60 inside a cylindrical body 63. Each slide 62 is joined to the inclined plate 5 by a connecting rod 64 provided at its two ends with ball joints 65 and 66 for connection to the inclined plate 5 and to the slide 62, respectively.

The inclined plate 5 is mounted so as to swivel about the axis 50 on a bearing 51 mounted on an inclined bearing surface 31 arranged on the driving component 3. The latter is also provided with an inclined bearing surface 32 positioned in a plane perpendicular to the axis 50 and upon which the inclined plate 5 bears through the intermediary of an axial abutment 52.

In addition, the driving component 3 also bears, through the intermediary of an axial abutment 33, upon a transverse plate 41 arranged at the opposite end of the column 4 from the pump 1 and perpendicular to the axis 30, the column 4 also carrying a bearing 34 for the axial guidance of the driving component 3.

The centers of the ball joints 65, connecting the connecting rod 64 to the plate 5, are positioned at the intersection points of the axes of sliding 60 of the pistons 6 with a plane perpendicular to the inclined axis 50 and passing through the center of oscillation 0, for the two extreme angular positions of the inclined plate for which the axis 50 lies in the radial plane passing through the longitudinal axis 30 and the axis 60 of the corresponding piston. The centers of the ball joints 66 connecting to the slides 62 are, of course, also positioned on the axes of sliding 60.

It will thus be seen that, when the driving component 3 is driven in rotation about its axis 30 by a mechanism 42, the inclined plate 5, which is itself locked in rotation by means which are not shown, oscillates about the center 0 and causes, through the intermediary of the connecting rods 64 and of the slides 62, an alternating motion of the pistons 6 along their axes 60.

The thrust of the pistons 6 is thus contained by the inclined plate 5 and transmitted to the driving component 3, and then to the fixed transverse plate 41, by the axial abutments 52 and 33, respectively.

This thrust should thus be carried by the casing 2 which incorporates a rear end wall 21, to which the pump 1 is fixed, and a front end wall 22 upon which the fixed transverse plate 41 bears.

According to the arrangement which forms the subject of U.S. Pat. No. 3,885,444 already mentioned, the thrust forces are carried by a tie rod 8 which passes inside the central tubular column 4 and is provided at its two ends with collars 81 and 82 bearing upon the rear end wall 21 and upon the front end wall 22, respectively. The latter takes the form of a box at whose center an axial column 23 is positioned, which is situated in the extension of the strut column 4, and upon which the latter bears on the same side as the pump.

According to the essential characteristic of the invention, the casing 2 is also provided with a number of lateral tie rods 80, positioned at its periphery, to carry the forces developed by the pistons, each in co-operation with the central tie rod, which are spaced, for this purpose, symmetrically relative to the radial planes passing through the longitudinal axis 30 and through the axes 60 of the pistons 6. Each piston 6 may thus correspond either to a single lateral tie rod 83 positioned in the corresponding radial plane P, or to two lateral tie rods 85 positioned symmetrically on each side of the corresponding radial plane.

Figure 2:
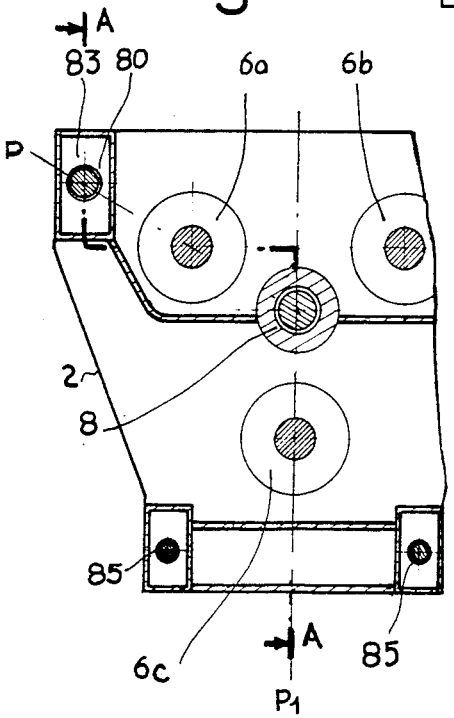
FIG. 2 is a view in transverse section along the line B—B shown in FIG. 1.

In the example shown, which corresponds to a pump with three pistons, the two solutions have been combined. In fact, as may be seen in FIG. 2, the casing 2 incorporates two upper lateral tie rods 83 whose centers lie in the radial planes corresponding to two pistons **6*a* and 6*b*, whereas the forces developed by the third piston 6*c* are carried, in co-operation with the central tie rod 8, by two other lower tie rods 85** positioned symmetrically on each side of the corresponding radial plane $P_1$.

The lateral tie rods are subjected, like the central tie rod 8, to a preload tension capable of opposing the thrusts of the pistons, and for this reason each tie rod 80 is provided at its ends with collars 87 for bearing upon the outer surfaces of the two end walls 21, 22 of the casing and pass through a strut column 24 constituting part of the casing and interposed between the two end walls so as to prevent the latter from moving towards one another under the action of the preload tension when the thrust of the corresponding piston is not being exerted in the opposite direction.

The preload tensions, and consequently the cross-sections of the tie rods are, of course, determined as a function of the forces developed by the pistons and of the distances of the axes 60 of the latter relative to the lateral tie rods 80 and to the central tie rod 8.

It will also be seen that the arrangement with two tie rods 85, 86 adopted for the piston **6*c* allows the driving mechanism 42 to be positioned between them, which mechanism incorporates, for example, a pinion keyed on a driving shaft 43, meshing with a toothed wheel 35 firmly fixed to the driving component 3**.

The casing assembly 2 is of welded and built construction and, owing to the solutions adopted, can be relatively light. Each end wall takes the form of a box consisting of transverse plates joined by struts. The latter are formed by the central column 23 and by the lateral columns 24 in the case of the rear end wall 21 which forms the fixed base of the installation to which are fixed, on one side, the pump 1 and, on the other side, the driving mechanism 3, 4, 5.

The front end wall 22 is formed of a box consisting of two lateral plates joined together by bulkhead struts 25 positioned around holes 26 for the tie rods 80 to pass through, in the extension of the walls of the columns 24 of the corresponding tie rod.

In addition, the frame 1 is advantageously provided with a fixing plate 12 which is fixed to the outer surface 27 of the rear end wall 21 and upon which the collars of the central tie rod 8 and of the lateral tie rods 80 bear, the tie rods passing through holes arranged in the plate 12.

This arrangement thus allows simple dismantling of the assembly of the pump 1, by unscrewing the tie rods.

The assembly of the casing and the hydraulic body thus forms a rigid preloaded unit, easily dismantled, and well capable of withstanding the heavy internal thrusts of the pistons.

Moreover, according to another advantageous arrangement, the axial thrust of the driving mechanism upon the front end wall 22 is carried along a circumference whose center lies on the longitudinal axis 30 and whose radius R equals the distance between the axis 30 and the axes 60 of the pistons. For this purpose, the transverse plate 41 is provided, on the same side as the end wall 22, with a circular bearing rib 44 having a mean radius equal to R. A disk 25 forming a spacer is interposed between the bearing rib 44 and the inner surface of the front end wall 22, and the central column 4 bears upon the end of the axial column 23 of the front end wall 21 through the intermediary of an adjustable abutment, which may consist, for example, of a nut 45 screwed on a thread arranged at the end of the column 4 facing towards the pump 1. In this way any appreciable axial play in the internal mechanical assembly is avoided, adjustment of the nut 45 allowing the central column 4 to be pushed back axially so as to ensure contact with the end wall 22 along the rib 44. A slight play (e) may also be arranged between the central portion of the front end wall 22 and a circular rib of smaller diameter arranged at the end of the central column 4 surrounding the hole through which the central tie rod 8 passes. This limits the distortion of the end wall 22 under the action of the preload tension applied to the central tie rod 8.

The invention is, of course, not limited to the details of the embodiment which is described above by way of a simple example, and which could be modified using equivalent means. This applies particularly to the physical construction of the mechanism, of the pump and of the casing. In particular, the latter could consist of a simple plate provided on its outer surface with reinforcing ribs passing through the longitudinal axis and through the axes of the lateral tie rods and of the corresponding pistons.

We claim:

1. A swash plate mechanism comprising (a) a drive element (3) mounted for rotation about a longitudinal axis (30);

(b) an inclined plate (5) bearing, through the intermediary of an axial abutment (52), upon the drive element (3) and mounted for swiveling movement on the latter about an axis (50) inclined relative to said longitudinal axis (30), and intersecting the latter at a center of oscillation (0);

(c) a plurality of pistons (6) spaced about said longitudinal axis (30), mounted for sliding movement about a plurality of axes (60) parallel to said axes in cylindrical bodies (61) arranged on a frame (11) and bearing individually upon the inclined plate (5), the latter being locked in rotation;

(d) said mechanism being located inside a casing (2) bounded by two spaced end walls including a rear end wall (21) to which said frame (11) is fixed, and a front end wall (22) upon which said drive element (3) bears;

(e) said walls being interconnected by pre-loaded tie rods located within strut columns forming part of said casing, said tie rods including a central tie rod (8) located in a central strut column and extending along said longitudinal axis (30), and a plurality of lateral tie rods (80) parallel to said axis, each of said lateral tie rods being located within a lateral strut column, at least two lateral tie rods (85,86) being spaced symmetrically on each side of a corresponding radial plane ($P_1$) passing through the axis of the corresponding piston (6) and having a drive mechanism therebetween, each of the other tie rods being centered in a corresponding radial plane (P) passing through said longitudinal axis and through the axis of the corresponding piston (6), said central tie rod (8) and said lateral tie rods (80) bearing upon the outer faces of said walls (21, 22) and being subjected to pre-loading tension for carrying the longitudinal forces developed by said pistons, the thrust of each piston being carried cooperatively by said central tie rod (8) and the corresponding lateral tie rod (80).

2. Swash plate mechanism according to claim 1, wherein said drive element (3) bears upon said front end wall (22) along a circumference (44) whose center lies on said longitudinal axis (30) passing through the axes (60) of said pistons (6).

3. Swash plate mechanism according to claim 2, in which said drive element (3) bears, through the intermediary of an axial abutment (33), upon a fixed transverse plate (41) arranged at the end of a central strut column (4), on the opposite side from said pistons (6), said transverse plate (41) being provided, on its outwardly facing surface, with a circular rib (44) for bearing upon said front end wall (22) whose center lies on said longitudinal axis (30) and whose mean radius (R) equals the distance between said longitudinal axis (30) and the axes (60) of said pistons (6).

4. Swash plate mechanism according to claim 3, wherein a disk (25) forming a spacer is interposed between the inner surface of said front end wall (22) and said circular bearing rib (44) and wherein said central column (4) bears at its opposite end upon said rear end wall (21) through the intermediary of an adjustment nut (45) meshing with a thread arranged at the end of said central column (4).

* * * * *